US006213076B1

(12) United States Patent
Fischer et al.

(10) Patent No.: US 6,213,076 B1
(45) Date of Patent: Apr. 10, 2001

(54) CYLINDER HEAD ASSEMBLY OF AN INTERNAL COMBUSTION ENGINE

(75) Inventors: Gerald Fischer, Höchstadt; Michael Haas, Weisendorf; Gerhard Maas, Herzogenaurach, all of (DE)

(73) Assignee: INA Wälzlager Schaeffler OHG, Herzogenaurach (DE)

( * ) Notice: Subject to any disclaimer, the term of this patent is extended or adjusted under 35 U.S.C. 154(b) by 0 days.

(21) Appl. No.: 09/367,366

(22) PCT Filed: Oct. 7, 1997

(86) PCT No.: PCT/EP97/05486

§ 371 Date: Aug. 11, 1999

§ 102(e) Date: Aug. 11, 1999

(87) PCT Pub. No.: WO98/36161

PCT Pub. Date: Aug. 20, 1998

(30) Foreign Application Priority Data

Feb. 14, 1997 (DE) ..... 197 05 726

(51) Int. Cl.[7] ..... F01L 1/14

(52) U.S. Cl. ..... 123/90.55; 123/90.12; 123/90.16

(58) Field of Search ..... 123/90.12, 90.55, 123/90.16, 90.48, 90.63, 90.46, 188.3

(56) References Cited

U.S. PATENT DOCUMENTS

| | | | | |
|---|---|---|---|---|
| 2,760,470 | * | 8/1956 | Bergmann | 123/90.55 |
| 4,567,862 | | 2/1986 | Kodama . | |
| 4,648,360 | * | 3/1987 | Schaeffler | 123/90.55 |
| 5,107,806 | * | 4/1992 | Dohring et al. | 123/90.55 |
| 5,159,907 | * | 11/1992 | Budde | 123/90.55 |
| 5,651,335 | * | 7/1997 | Elendt et al. | 123/90.16 |
| 5,673,662 | * | 10/1997 | Rigamonti | 123/90.55 |
| 5,709,181 | * | 1/1998 | Williams | 123/90.46 |
| 5,782,216 | * | 7/1998 | Haas et al. | 123/90.16 |
| 5,823,151 | * | 10/1998 | Elendt et al. | 123/90.16 |
| 5,860,399 | * | 1/1999 | Speil et al. | 123/90.55 |
| 5,975,038 | * | 11/1999 | Fischer et al. | 123/90.55 |
| 6,032,631 | * | 3/2000 | Haas et al. | 123/90.55 |
| 6,053,133 | * | 4/2000 | Faria et al. | 123/90.16 |
| 6,119,643 | * | 9/2000 | Haas et al. | 123/90.55 |
| 6,119,644 | * | 9/2000 | Speil | 123/90.55 |

FOREIGN PATENT DOCUMENTS

| | | |
|---|---|---|
| 35 00 425 A1 | 7/1986 | (DE) . |
| 43 14 619 | 11/1994 | (DE) . |
| 195 09 052 A1 | 2/1996 | (DE) . |
| 195 28 505 A1 | 2/1997 | (DE) . |
| 196 03 916 | 8/1997 | (DE) . |

* cited by examiner

*Primary Examiner*—Teresa Walberg
*Assistant Examiner*—Fadi H. Dahbour
(74) *Attorney, Agent, or Firm*—Henry M. Feiereisen

(57) ABSTRACT

A tappet (1) for a valve drive of an internal combustion engine is so designed as to be switchable for different valve lifts and includes an outer circular ring shaped section (5) which encloses a circular section (6). Both sections (5, 6) are acted upon by cams of different lifts, and selectively interconnectable together by coupling elements (9). According to the invention, a juncture (12) for hydraulic fluid is positioned in the skirt (2) and extending from a feed bore (13) in the cylinder head (4) at a lowest point of the tappet (1), when viewed in direction of gravity, in order to install the tappet (1) in an extreme slanted disposition. In opposition thereto, a port (21) of the channel (27), following the juncture (12), is arranged at a highest section of the tappet (1), when viewed in the direction of gravity. Thus, after shut-down of the internal combustion engine, a reservoir (17) can empty only to the level of the port (21), so that the tappet (1) is sufficiently filled with hydraulic fluid when restarting the internal combustion engine.

7 Claims, 2 Drawing Sheets

CYLINDER HEAD ASSEMBLY OF AN INTERNAL COMBUSTION ENGINE

FILED OF THE INVENTION

The invention relates to a cylinder head assembly of an internal combustion engine, and more particularly to a tappet for a valve drive of an internal combustion engine, including an outer circular ring shaped section which encloses a circular section movable axially relative thereto, with both sections acted upon in the area of their bottoms by cams of different lifts, and selectively interconnectable by coupling elements which lap over a ring surface between the sections and acted upon at least in one direction of displacement by a servo means, such as hydraulic fluid, with the servo means being conducted from a feed bore, terminating in the receiving bore of the cylinder head, through a juncture in the skirt in communication with the feed bore, along at least one channel extending preferably on the inner wall of the skirt, to a first reservoir between the bottom of the circular ring shaped section and a radial web disposed underneath the bottom in direction of the tappet and arranged between the skirt and the circular section.

BACKGROUND OF THE INVENTION

A tappet of this type is disclosed in German publication DE-OS 43 14 619. In the event, the tappet should be installed in its receiving bore in the cylinder head at a significant angle to the vertical, i.e. in an extreme slanted disposition, an unfavorable assembly situation may occur in which the annular reservoir, which is bounded by the circular ring shaped section, as well as partial regions of a central reservoir, which is enclosed by the circular section, may substantially run empty on hydraulic fluid. This, for example, may be ascertained when the tappet should be integrated in a valve drive of an opposed engine with cylinder barrels extending orthogonal to the vertical.

The lack of sufficient hydraulic fluid and the resultant accumulation of air in the reservoirs leads, on the one hand, to a restriction of a clearance compensation function of a hydraulic clearance compensation element, which is connected to the circular section, as a consequence of compressibility of its high pressure chamber over a certain period, and, on the other hand, to misalignments of the coupling elements for selectively connecting the sections to one another.

OBJECT OF THE INVENTION

It is thus an object of the invention to provide a slantingly mounted tappet of the afore-stated type, obviating the afore-stated drawbacks and so designed as to result in a tappet which reliably prevents leakage of servo means with particularly simple measures.

SUMMARY OF THE INVENTION

This object is attained by the providing the receiving bore for the tappet at an angle of 45–90° with respect to the vertical, with the juncture of the skirt being disposed at a lowest point of the tappet, when viewed in direction of gravity, and with a port of the channel into the first reservoir being positioned in the area of a highest section of an edge of the radial web, when viewed in direction of gravity.

By disposing the juncture of the skirt at the lowest point of the tappet, when viewed in direction of gravity, and at the same time positioning the port of the channel into the first reservoir at the highest section of an edge of its radial web, when viewed in direction of gravity, the first ring-shaped reservoir, when shutting down the internal combustion engine, runs empty on hydraulic fluid only to the level of the port of the channel. Thus, a sufficiently large amount of hydraulic fluid is retained in this reservoir when restarting the internal combustion engine, whereby this amount ensures, on the one hand, an unobjectionable clearance compensation function of the clearance compensation element, and, on the other hand, the immediate availability of a sufficient hydraulic fluid column in front of the coupling elements for displacement of the coupling elements.

According to a first embodiment of the invention, it is proposed to design the channel, starting from the juncture in the skirt, as circumferential groove at the inner wall and subsequently continued in the form of a longitudinal channel on the inner wall of the skirt in the direction towards the edge of the radial web. This circumferential groove may also be substituted by a helical groove which extends at the inner wall of the skirt up to the port at the edge of the radial web.

The invention is, in particular, appropriate when positioning the feed bore for supply of the hydraulic fluid to the juncture in the skirt substantially beneath the tappet, when viewed in direction of gravity. A disposition of the feed bores above the tappet eliminates the problems, as referred to above, and relating to an emptying of the first reservoir of hydraulic fluid.

Instead of the described helical configuration or configuration of an annular channel with subsequent axial channel, other designs are conceivable as well, as long as the port into the first reservoir is arranged at a geodetic elevated position of the tappet.

A concrete feature of the invention includes the formation of the channel in a separate axial section which extends along the inner wall of the skirt. According to a further development of the invention, this separate axial section may be an integral part of a radial web which bounds the first reservoir in cam-distal direction. Suitably, the axial section and the radial web are made of sheet metal or similarly appropriate material.

Application of the features according to the invention is in particular useful when providing the tappet with a hydraulic clearance compensation element. At the same time, it is proposed to provide in the skirt only one juncture for hydraulic fluid for acting commonly upon the clearance compensation element and the coupling elements. This measure particularly simplifies the assembly.

The invention is not limited to the cup-shaped tappet as involved here, but relates also to further valve drive elements, such as roller tappets, hydraulic support elements or like members that run the risk that their reservoirs empty when installed in slanted disposition.

BRIEF DESCRIPTION OF THE DRAWING

Suitably, the invention will now be described in more detail with reference to the accompanying drawing, in which.

DETAILED DESCRIPTION OF THE DRAWING

Figure 1:
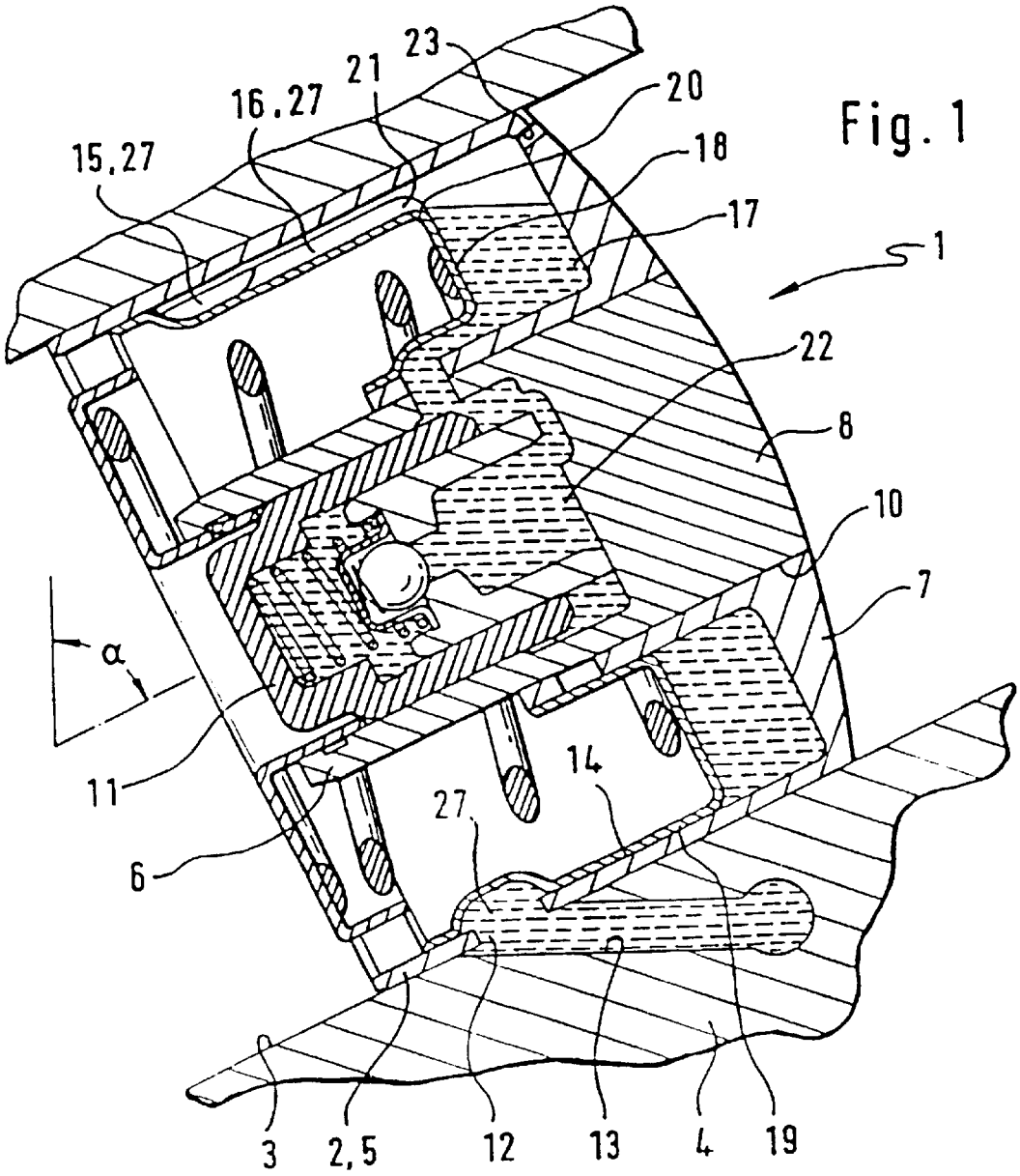
FIG. 1 is a longitudinal section through a tappet, taken along the line I—I of FIG. 3, and installed in slanted disposition.

FIG. 1 shows a principal structure of a tappet 1 for a valve drive of an internal combustion engine, as sufficiently known to the artisan. The tappet 1 includes an oscillating circular ring shaped section 5 secured in fixed rotative engagement with its hollow cylindrical skirt 2 in a receiving bore 3 of a cylinder head 4. The circular ring shaped section 5 is positioned in concentric surrounding relationship to a circular section 6. The circular section 6 is axially movable relative to the circular ring shaped section 5. Both sections 5, 6 are acted upon in the area of their bottoms 7, 8 by cams of different lifts, with the circular ring shaped section 5 being acted upon by two cams of large lift and the circular section 6 being acted upon by a cam of small or zero lift. Both sections 5, 6 can be linked together via coupling elements 9 (see FIG. 2) arranged in the area of their bottoms 7, 8 and not described in more detail. When disengaged, these coupling elements 9 are arranged in this configuration in the circular ring shaped section 5 and, for linkage of both sections 5, 6, lap over a ring surface 10 between the sections 5, 6. As seen from FIG. 2, the coupling elements 9 are acted upon by a servo means, such as hydraulic fluid, for realizing the linkage, and displaced radially outwards by compression spring force for realizing a disengagement.

As shown in FIG. 1, the tappet 1 is installed in the receiving bore 3 of the cylinder head 4 at a significant slanted disposition with respect to the vertical. An angle $\alpha$ between 45° and 90° with respect to the vertical is conceivable. Hydraulic fluid is supplied to the coupling elements 9 and to a clearance compensation element 11, fitted in the circular section 6, via a juncture 12 in the form of a through opening formed in the skirt 2. This juncture 12 is arranged at a lowest point of the tappet 1, when viewed in direction of gravity, and is acted upon via a feed bore 13 from the cylinder head 4.

Figure 3:
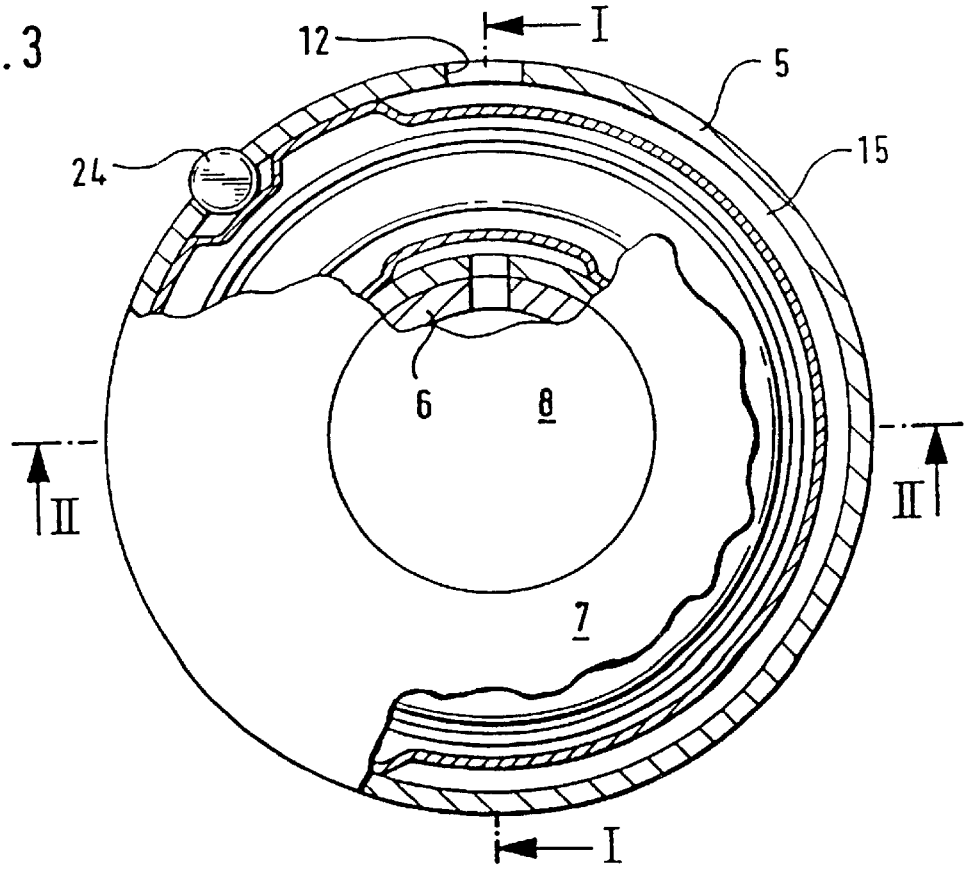
FIG. 3 is a cross section through the tappet.

According to a first proposal, as shown in FIGS. 1 and 3, a circumferential groove 15 is connected to the juncture 12 of the skirt 2 and extends upon an inner wall 14 of the skirt 2. This circumferential groove 15 extends approximately about an angle of 180°. The circumferential groove 15 terminates diametrically opposite to the juncture 12 in a longitudinal groove 16. This longitudinal groove 16 extends again upon the inner wall 14 of the skirt 2 in the direction towards the bottom 7 of the circular ring-shaped section 5. As viewed in cam-distal direction, a first annular reservoir 17 is arranged underneath the bottom 7 for hydraulic fluid and bounded by a radial web 18. In accordance with the embodiment illustrated here, the radial web 18 is designed in one piece with an axial section 19 extending on the inner wall 14 of the skirt 2. The longitudinal groove 16 is formed in this axial section 19.

In the area of a highest section of an edge 20 of the radial web 18, as viewed in direction of gravity, the longitudinal groove 16 has a port 21 into the first reservoir 17. Since the port 21 is positioned almost at the highest point in the slanted disposition of the tappet 1, as shown in FIG. 1, the first reservoir 17 and a further reservoir 22, enclosed by the hydraulic clearance compensation element 11 can no longer substantially run empty on hydraulic fluid, when the internal combustion engine shuts down. Thus, when restarting the internal combustion engine, the clearance compensation function of the clearance compensation element 11 is immediately established and a possibility of an uninhibited acting upon the coupling elements 9 is effected. The clearance compensation element 11 has the desired stiffness for transmission of the lift of one of the cams.

Air possibly accumulating in the first reservoir 17 may be conducted to the outside via an escape bore 23. This escape bore 23 is arranged at a geodetic highest point of the tappet 1 and may, for example, be made as laser bore. The diameter of this escape bore 23 is thereby advantageously so sized as to allow escape of air but hardly of any hydraulic fluid.

FIG. 3 shows a cross section of the tappet 1. Especially illustrated is the arrangement of the circumferential groove 15, extending from the juncture 12 in the skirt 2.

Moreover, FIG. 3 shows that the skirt 2 is provided with an anti-rotation device 24. By means of this anti-rotation device 24, the tappet 1 is in fixed rotative engagement in its receiving bore 3. This anti-rotation device 24 may, for example, be made as roller needle (see FIG. 2) and is necessary in particular when the bottoms 7, 8 have a cylindrical configuration, when viewed in direction of the camshaft. The cylindrical configuration of the bottoms 7, 8 is of particular advantage because the cams are assured a sufficiently large area of contact which is in immediate correlation with a further miniaturization of the tappet 1.

Figure 4:
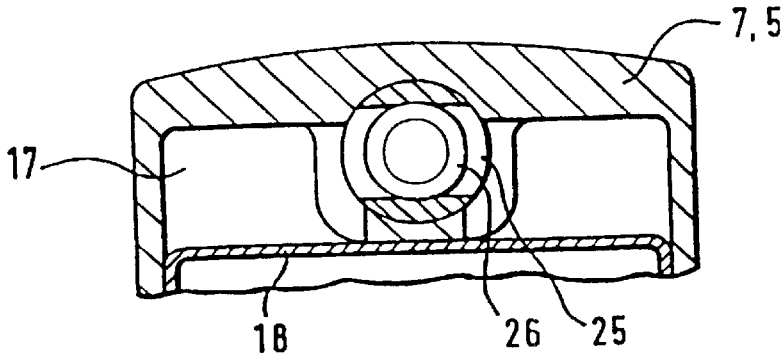
FIG. 4 is a section, taken along the line IV—IV in FIG. 2.
Figure 2:
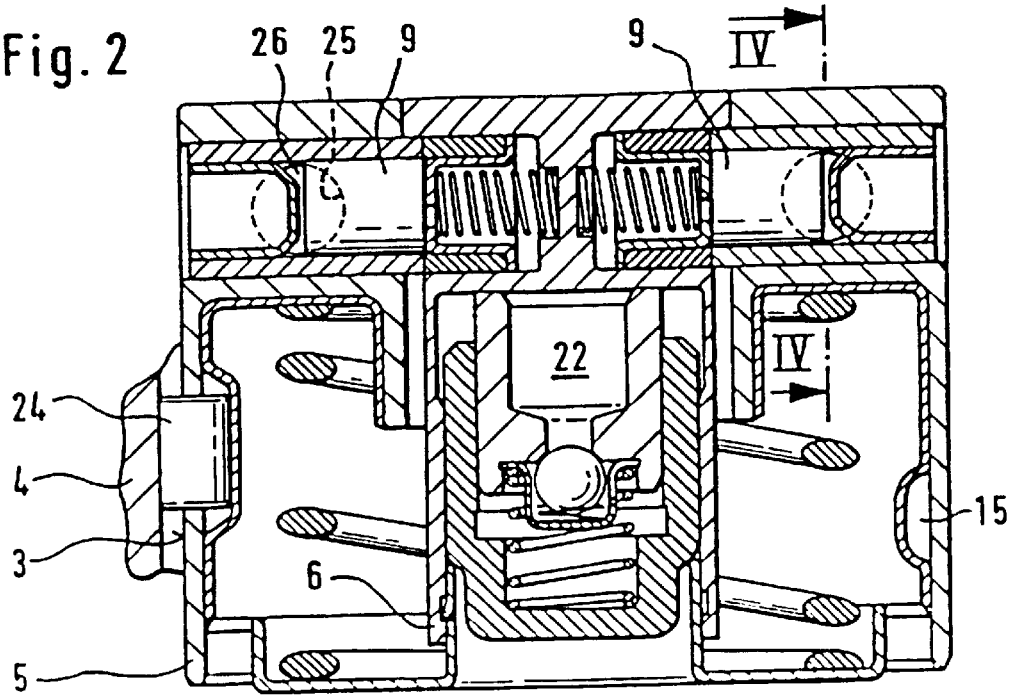
FIG. 2 is a sectional view of FIG. 1 in a 90° rotated position, taken along the line II—II in FIG. 3.

Finally, FIG. 4 discloses a sectional view, taken along the line IV—IV of FIG. 2, and shows an inlet 25 which extends from the first reservoir 17 to a first piston space 26 in front of the coupling elements 9. Thus, a common channel 27 extends to the first reservoir 17 for actuation of the coupling elements 9 and for supply of the hydraulic clearance compensation element 11 in the tappet 1.

As servo means conducted via the feed bore 13, the use of brake fluid or a further alternative fluid instead of hydraulic fluid is also conceivable.

What is claimed is:

1. A cylinder head assembly for an internal combustion engine, comprising:

a cylinder head body having a receiving bore which extends at an angle of 45° to 90° with respect to a vertical, and a feed bore for conducting a hydraulic fluid; and a tappet including a cylindrical circular ring shaped section having a hollow cylindrical skirt which is secured in fixed rotative engagement in the receiving bore of the cylinder head and includes a through opening which is fluidly connected to the feed bore of the cylinder head body and disposed at a lowest point of the tappet, when viewed in direction of gravity;

a circular section axially movable relative to and enclosed by the circular ring shaped section, each said sections having a bottom acted upon by cams of different lift;

coupling means for interconnecting the sections;

an insert received in the circular ring shaped section and demarcating with the circular ring shaped section a fluid reservoir which is fluidly connected with a piston space positioned anteriorly of the coupling means; and fluid passageway means for conducting a hydraulic fluid from the feed bore in the cylinder head body to the fluid reservoir, said fluid passageway means including a first channel fluidly connected to the through opening of the skirt and extending along an inner wall of the skirt to terminate in a port for communication with the fluid reservoir, said port being positioned in an area of a highest point of an edge of the insert, when viewed in direction of gravity.

2. The cylinder head assembly of claim 1, wherein the fluid passageway means includes a second channel formed as a longitudinal groove, said first channel being formed as a circumferential groove extending from the through opening in the skirt and terminating at a highest point in the longitudinal groove, when viewed in direction of gravity, said longitudinal groove having a reservoir-proximal end which defines the port.

3. The cylinder head assembly of claim 2, wherein the insert includes a radial web demarcating the fluid reservoir and an axial section extending along the inner wall of the skirt, said first channel being formed in the axial section.

4. The cylinder head assembly of claim 3, wherein the axial section is formed in one piece with the radial web.

5. The cylinder head assembly of claim 1, wherein the first channel is designed as a helix or helix-like configuration and has at least one half winding up to the port.

6. The cylinder head assembly of claim 1, wherein the tappet has a hydraulic clearance compensation element (11) which is mounted in the circular section.

7. The cylinder head assembly of claim 6, wherein the fluid passageway means conducts hydraulic fluid for common actuation of both, the clearance compensation element and the coupling means.

* * * * *